United States Patent [19]

Chatow

[11] Patent Number: 4,619,724

[45] Date of Patent: Oct. 28, 1986

[54] METHOD FOR PRODUCING FABRIC AND GARMENTS

[76] Inventor: Yser Chatow, 15 Rehov HaAviv, Petach Tikva, Israel

[21] Appl. No.: 420,691

[22] Filed: Sep. 20, 1982

[30] Foreign Application Priority Data

Dec. 20, 1981 [IL] Israel ..... 64594

[51] Int. Cl.[4] ..... B32B 5/16

[52] U.S. Cl. ..... 156/72; 264/86; 264/103; 264/154; 264/344; 264/504; 264/510; 264/518; 264/DIG. 47

[58] Field of Search ..... 156/72, 62.2, 62.8; 264/103, 86, 154, 344, 504, 510, 518, DIG. 47

[56] References Cited

U.S. PATENT DOCUMENTS

| | | | |
|---|---|---|---|
| 3,032,774 | 5/1962 | Wade | 264/121 |
| 3,615,967 | 10/1971 | Stebler | 156/72 |
| 3,681,157 | 8/1972 | Smock | 156/62.2 |
| 3,801,396 | 4/1974 | Stienhoudt | 156/62.2 |
| 3,816,159 | 6/1974 | Newman | 156/62.2 |
| 4,196,027 | 4/1980 | Walker et al. | 156/62.2 |
| 4,328,270 | 5/1982 | Kostovski | 156/72 |
| 4,379,189 | 4/1983 | Platt | 156/72 |

FOREIGN PATENT DOCUMENTS

| | | | |
|---|---|---|---|
| 53-41580 | 4/1978 | Japan | 264/DIG. 47 |
| 54-27065 | 3/1979 | Japan | 264/103 |
| 54-27066 | 3/1979 | Japan | 264/103 |
| 1083847 | 9/1967 | United Kingdom | 264/DIG. 47 |
| 1228877 | 4/1971 | United Kingdom | 156/62.2 |

*Primary Examiner*—James Lowe

*Attorney, Agent, or Firm*—Browdy and Neimark

[57] ABSTRACT

A method for producing a fabric item comprising the steps of producing a perforated substrate in the shape of the desired fabric item, supplying fibers to the perforated substrate, causing the fibers to engage the perforations in the substrate, and retaining the fibers in the perforations.

13 Claims, 14 Drawing Figures

METHOD FOR PRODUCING FABRIC AND GARMENTS

FIELD OF THE INVENTION

The present invention relates to textiles and more particularly to apparatus and methods for producing non-woven materials and garments.

BACKGROUND OF THE INVENTION

Garments sewn of conventional woven cloth represent the result of a great number of processing steps including the following, for example: carding of the fibers, yarn spinning, weaving, fabric finishing, fabric cutting, sewing, washing, and pressing. The production of garments from conventional woven cloth is, therefore, both labor and capital intensive.

Various proposals have been made in the prior art for producing material and garments in a much less expensive way. One such area of investigation that has enjoyed some market exposure is the use of non-woven fabrics. U.S. Pat. Nos. 3,032,774 and 3,179,955 describe a technique for producing a seamless garment of a non-woven fabric in which individual fibers are blown into a chamber and into engagement with a mold. A binder is applied to the fibers while they are in engagement with the mold and defines the garment shape.

Garments produced in accordance with the teachings of the aforementioned U.S. patents involve a number of disadvantages, namely that they do not tend to hold their shape in use and, due to the flat arrangement of fibers thereon, the fibers do not provide an adequate passage of moisture through the fabric. In addition, these methods produce a layer of fibers on a forming surface which is later separated from the garment and thus does not form a part thereof. For these reasons, inter alia, many non-woven fabrics are designed for disposable applications, i.e. one time use only.

One known method of strengthening a web of material is to work the web with barbed needles which mechanically push some fibers through the web. A similar method of punching fibers through a plastic sheet using needles is described in U.S. Pat. No. 3,994,759.

An alternate method of producing a strengthened non-woven fabric utilizing interacting fibers is described in U.S. Pat. No. 3,485,706. The method disclosed therein comprises supporting a web or batt of loose fibrous material upon a perforated screen or other patterning member. Very high energy jets of water at high pressure are sprayed along the web by means of nozzles of very small diameter. The jets of water serve to force the loose fibers or portions of fibers to become entangled with one another and to project through the perforations or depressions in the patterning member, thus producing a textured fabric of the desired pattern upon removal of the web from the supporting patterning member.

It is also well known to produce multiple use clothing items from individual fibers. One example is the manufacture of hats, as described, for example, in U.S. Pat. No. 2,277,042, in which a perforated cone is connected to a source of negative pressure at the interior thereof and individual fibers are distributed on the cone from the outside thereof and are temporarily retained thereon by the applied vacuum. An adhesive binder is applied to the fibers and the perforated cone is removed.

SUMMARY OF THE INVENTION

The present invention seeks to provide apparatus and a technique for producing garments which overcome the disadvantages of prior art woven, knit, tufted and non-woven materials and garments.

There is thus provided in accordance with an embodiment of the present invention a method for producing a fabric item comprising the steps of producing a perforated substrate in the shape of the desired fabric item, supplying fibers to the perforated substrate, causing the fibers to engage the perforations in the substrate, and retaining the fibers in the perforation.

Further in accordance with an embodiment of the present invention, the perforated substrate comprises a stretchable substrate.

Additionally in accordance with an embodiment of the present invention, the step of producing the perforated substrate comprises the step of inserting a mold into a bath of fluidized plastic material, such as latex, plastisol or powder.

Further in accordance with an embodiment of the present invention, the step of supplying fibers comprises the step of causing fibers to flow into engagement with the perforations in the substrate.

Additionally in accordance with an embodiment of the invention, the perforations are expanded during the steps of supplying the fibers and causing the fibers to engage the perforations thereby to facilitate the entry of fibers thereinto.

Further in accordance with an embodiment of the present invention, the step of causing the fibers to flow includes the application of a positive pressure gradient for driving the fibers.

Additionally in accordance with an embodiment of the present invention, the substrate may comprise a multi-layered substrate.

Further in accordance with an embodiment of the present invention, the substrate may comprise a layer of a binder which is operative, when activated to bind the fibers in the perforations.

The blowing step mentioned above may be carried out with the aid of a driven fluid such as pressurized air, or alternatively, a liquid.

Additionally in accordance with an embodiment of the invention, there is provided apparatus for carrying out the various steps described hereinabove.

Further in accordance with an embodiment of the present invention there is provided an article which is manufactured in accordance with any of the method steps described hereinabove.

Additionally in accordance with an embodiment of the present invention, there is provided a method for producing a fabric item comprising the steps of providing a substrate and causing an additional coating or covering layer to grow onto or through the substrate. The coating or covering may be a fiber or crystal structure which is chemically or organically grown on the substrate. The substrate may be formed with precursors of the structure to be grown thereon.

Further in accordance with an embodiment of the present invention there is provided a method for producing a fabric item comprising the steps of providing a perforated substrate and extruding fibers through the substrate.

Additionally in accordance with an embodiment of the present invention, fibers may be looped through a perforated substrate.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
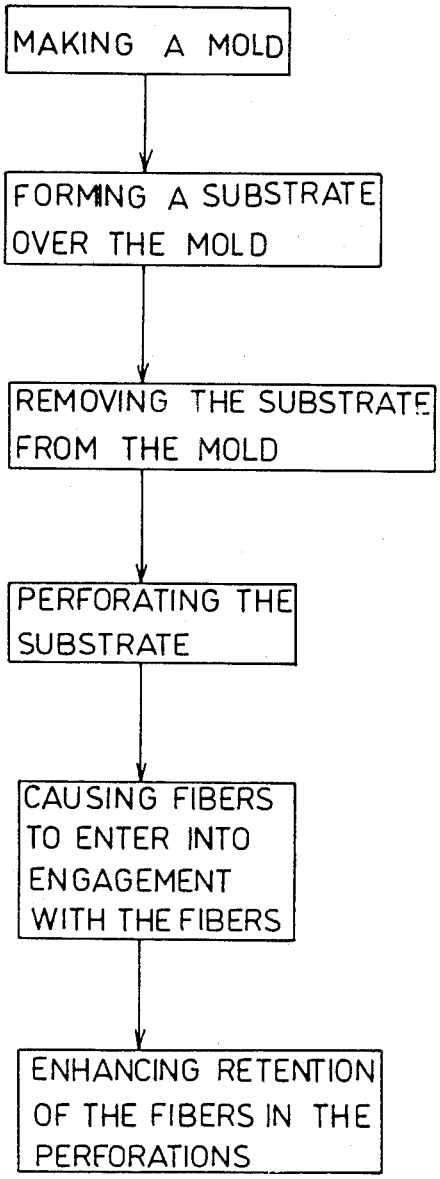
FIG. 1 is a flow-chart illustrating a method for producing a fabric item in accordance with an embodiment of the present invention.

Reference is now made to FIG. 1 which is a general flow chart illustration of the steps comprising a technique for producing fabrics and qarments in accordance with a preferred embodiment of the present invention. The term "fabric" is used throughout the description and claims to denote any type of web constructed in accordance with the present invention. The term "fiber" is employed throughout the description and claims to denote any generally elongate element, however formed, of any desired length or cross sectional configuration, having uniform or non-uniform cross section, which is employed in the present invention.

For the sake of completeness of description, FIG. 1 and the description which follows, relate to the manufacture of a complete or semi-complete garment which has a generally shaped configuration, as distinguished from a simple web. It is appreciated that a web may also be constructed in accordance with the present invention by omitting certain unnecessary steps.

In accordance with the present invention, the manufacture of a shaped garment, such as a shirt, begins with the provision of a three dimensional positive mold in the desired general shape of the finished product. The size of the mold need not necessarily correspond to the desired size of the finished product. The mold may have a generally smooth outer surface or alternatively may be formed with a plurality of outwardly extending protrusions (not shown) or perforations thereby to define protrusions in the molded article.

Figure 2A:
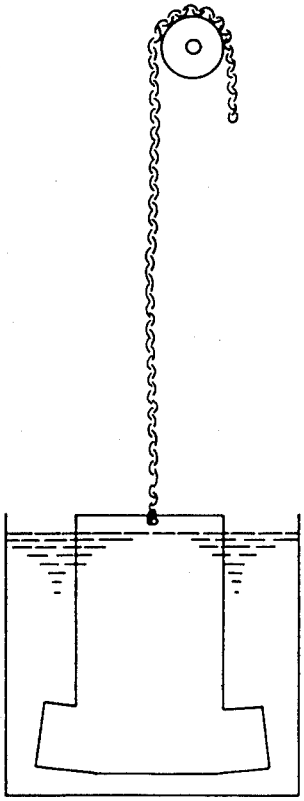
FIGS. 2A and 2B are pictorial illustrations of apparatus for producing a moulded substrate in accordance with an embodiment of the present invention.
Figure 2B:
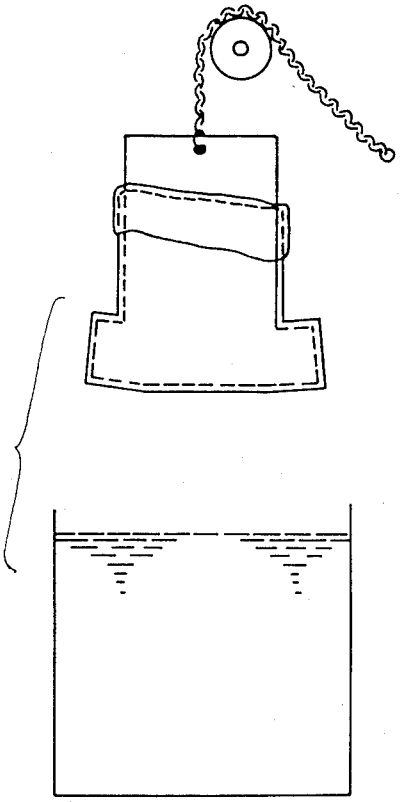

A substrate is formed over the mold, preferably as by dipping the mold in a bath of substrate forming material as seen in FIG. 2A. The substrate forming material may be any suitable material for providing a flexible substrate. One example of such material is latex. Other examples are plastic materials which may be maintained in a liquid state in a bath and then cured into a flexible substrate, such as plastisol, or powder. Once the substrate forming material has set on the mold, the substrate is removed from the mold, as seen in FIG. 2B. Alternatively, the substrate may comprise a stretchable substrate, such as a homogeneous plastic or rubber sheet.

Following separation of the substrate from the mold, the substrate undergoes a perforation defining step. Where a web, as opposed to a garment, is manufactured, no mold need be used and the web may be formed by rolling or a similar technique. The substrate web may be then subjected to the perforation defining step.

The perforation defining step may involve a number of alternative possibilities. Where a mold having a multiplicity of protrusions is provided, the perforation defining step involves more trimming of excess substrate forming material from the protrusions to form perforations. Where perforations have not been formed in the molding of the substrate, roller apparatus as seen in FIG. 3 may be employed.

Figure 3:
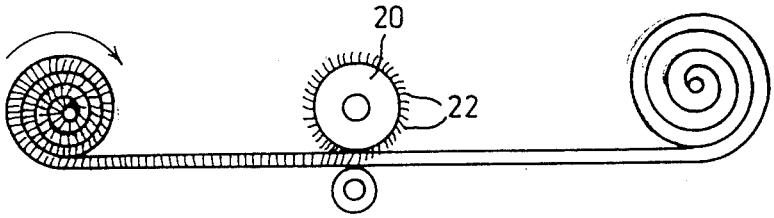
FIG. 3 is a pictorial illustration of apparatus for perforating the substrate.

The roller apparatus of FIG. 3 may typically comprise a roller 20 having a plurality of pins or blades 22 formed thereon which engage the substrate for perforation thereof. The use of a roller is particularly suitable for producing perforations in web material.

An alternative technique for producing perforations in the substrate is to disperse uniformly in the substrate material grains or other small particles of material, such as starch, which can be dissolved after setting of the substrate by suitable chemical or other techniques to define apertures.

Alternatively perforations in the substrate may be formed by employing a perforated mold coupled to a source of positive or negative pressure. As a further alternative, particles, dispersed in the substrate material can be blown out of the material to define perforations therein by means of a driven fluid such as pressurized air or a liquid.

It may be appreciated that the apertures formed in the substrate may be of any suitable configuration and size.

Following the perforation defining step is the fiber engagement step. In this step, individual fibers are caused to enter into engagement with the perforations defined in the substrate. According to a preferred embodiment of the invention, the fiber engagement step occurs generally simultaneously over an entire garment-defining substrate.

Figure 4:
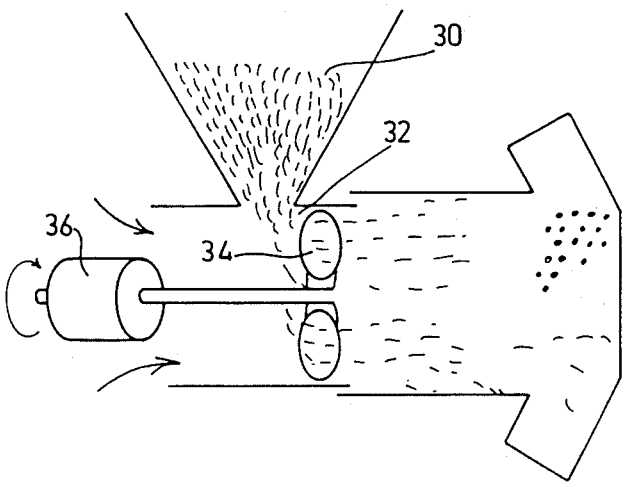
FIG. 4 is a pictorial illustration of apparatus for applying fibers to the substrate.

FIG. 4 illustrates apparatus for carrying out the fiber engagement step. The apparatus comprises a fiber supply bin 30 which supplies fibers to a forced air positive pressure fiber distribution conduit 32 which is coupled to an opening, such as the waist opening, of a garment, such as a shirt. The remaining openings of the garment are preferably closed. A fan 34, powered by a motor 36 provides a positive pressure gradient within the garment, such as 1 to 10 psi, thus preferably expanding the garment and consequently expanding the perforations defined therein. The operation of fan 34 is operative to drive individual fibers into engagement with the perforations in a generally uniform manner, such that the fibers extend through the perforations and are retained therein.

Retention of the fibers in the perforations during the fiber engagement step may be enhanced by providing fibers having relatively narrow ends and a relatively large cross section center portion, such that the central portion is retained in the perforation.

It is appreciated that fluids other than air may be used in the fiber engagement step. Driven liquids may alternatively be employed.

Once a desired density of fibers has been retained in the perforations, the fiber engagement step is terminated and the fiber securing step begins. The fiber securing step may take place in a number of alternative embodiments. According to one embodiment, the fibers may be secured in the perforations by means of an adhesive bonding substance which is sprayed onto at least one surface of the substrate.

According to an alternative embodiment of the present invention, the substrate may comprise a thermoplastic sealing material which in response to the application of heat or a chemical agent is operative to fuse to the fibers engaged in the perforations. In such a case, the substrate may be a multilayer substrate containing at least one layer of such a fusible material.

It is a particular feature of the present invention that following the fiber securing step, there is provided a fabric in which the fibers extend generally perpendicular to the substrate. This arrangement greatly enhances the moisture transfer properties of the resulting fabric.

A qarment shapinq step in which the garment is stretched, shrunk or shaped to a desired final shape by suitable thermal or chemical treatment of the fiber containing substrate may follow the fiber securing step.

Figure 5:
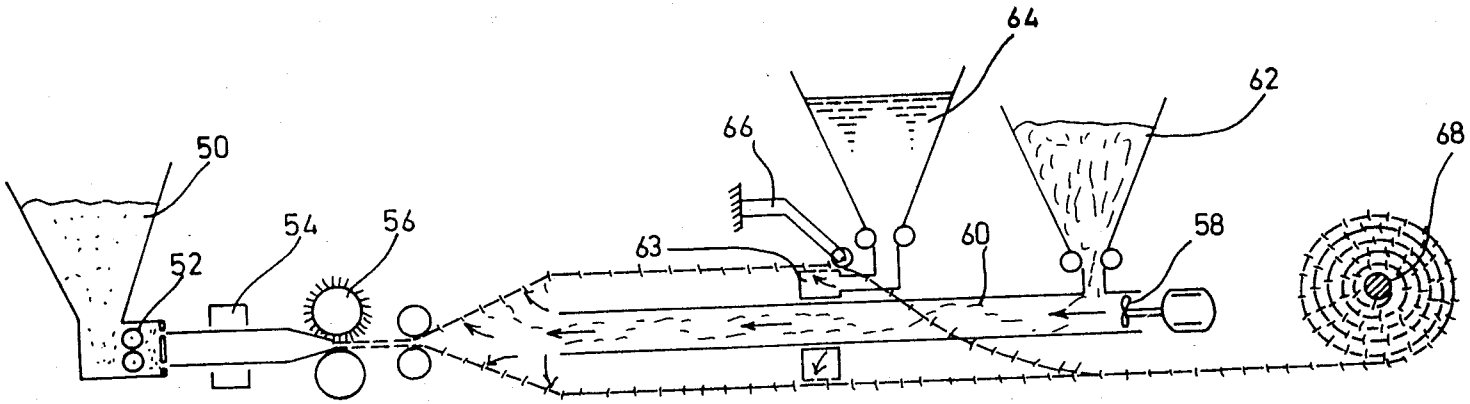
FIG. 5 is a diagrammatic illustration of apparatus for producing a fabric item in accordance with the present invention.

Reference is now made to FIG. 5 which summarizes the generalized method of the invention described above for web material. In the embodiment of FIG. 5, there is provided a bin of substrate forming material 50 which supplies this material to an extruder head 52. The extruder head 52 produces a sleeve of substrate material which passes a curing unit 54 and then a perforating roller 56 as seen in FIG. 3. The sleeve is then opened and stretched by a flow of pressurized air from a fan 58 which drives a flow of individual fibers 60 from a supply bin 62 into engagement with the perforations in the substrate sleeve. A binding agent is sprayed onto the inside surface of the sleeve following engagement of the fibers therewith by means of an applicator 63 communicating with a binder supply container 64.

The sleeve is then slit by cutting apparatus 66 and rolled by rolling apparatus 68 for storage and shipping.

It is appreciated that, instead of engagement of individual fibers, groups of fibers may be inserted separately or together into a given protrusion. Different densities of fiber engagement may also be provided as desired.

Figure 6:
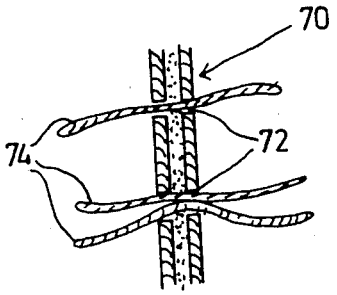
FIG. 6 is an illustration of a portion of a fabric item constructed and operative in accordance with an embodiment of the present invention.

Reference is now made to FIG. 6 which illustrates a portion of fabric constructed in accordance with the present invention and comprising a substrate 70 having perforations 72 formed therein. One or more individual fibers 74 are located in each aperture and are bound therein by means of a binding agent layer or layers forming part of or associated with the substrate.

Figure 7:
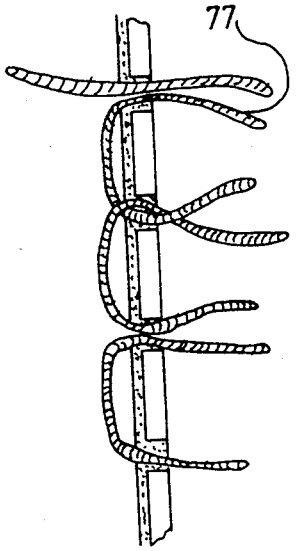
FIG. 7 is an illustration of an alternative embodiment of fabric item.

Reference is now made to FIG. 7 which illustrates a portion of fabric constructed in accordance with an alternative embodiment of the invention. In this embodiment, the fibers 77 are looped through two adjacent perforations in the substrate and are bonded on the surface opposite to that where the free ends of the fibers are located. This embodiment provides significant advantages in terms of fiber pluck resistance. Fabric constructed in accordance with the embodiment of FIG. 7 may be constructed by apparatus providing two alternating oppositely directed flows of air against the substrate.

Figure 8:
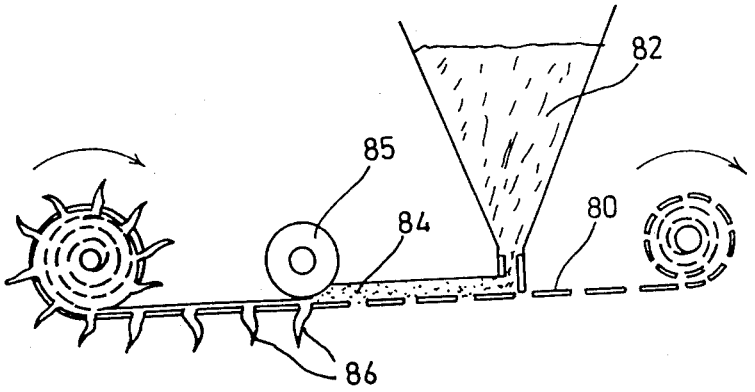
FIG. 8 is a diagrammatic illustration of apparatus for producing a fabric item in accordance with the embodiment of the present invention.

Reference is now made to FIG. 8 which illustrates a technique for manufacturing a fabric according to an alternative embodiment of the present invention. In the embodiment of FIG. 8 a perforated substrate 80 is presented to an applicator of a fiber forming material 82 which provides a layer 84 of fiber forming material thereon. A pressure roller 85 enqaqes the substrate 80 over the layer 84 and forces the fiber forming material 82 through the perforations in the substrate to define fibers 86. The fibers pass a curing stage and then the substrate having the fibers associated therewith is rolled for storage and shipment.

Figure 9:
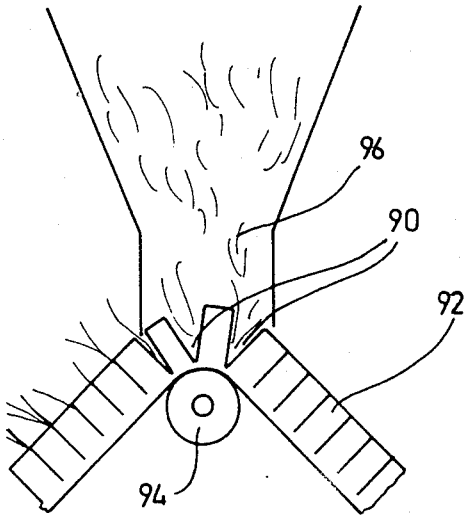
FIG. 9 is a diagrammatic illustration of apparatus for producing a fabric item in accordance with an alternative embodiment of the present invention.

Reference is now made to FIG. 9 which illustrates an alternative embodiment of a technique for manufacturing a fabric. In this embodiment slits 90 are formed in a substrate 92. The substrate is caused to pass over a roller 94 so as to become oriented with the separation of the slits at a maximum. At this juncture, fibers 96 are caused to engage the interstices between adjacent portions of the substrate 92. A binder may also be provided. Following introduction of the fibers, the slits are closed and the substrate is removed for further processing or storage and shipping.

Figure 10A:
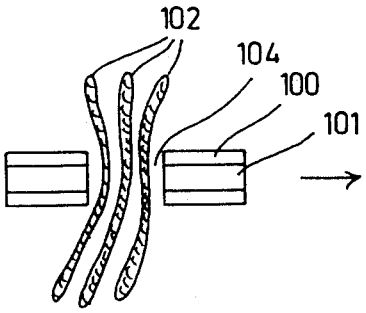
FIGS. 10A and 10B are illustrations of a technique for retaining fibers in a substrate in accordance with an embodiment of the present invention.
Figure 10B:
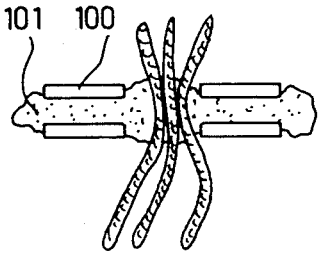

FIGS. 10A and 10B illustrate the use of a multilayer substrate 100 which includes an intermediate layer 101 of foaming binder material. FIG. 10A illustrates a portion of substrate having a plurality of fibers 102 engaging a perforation 104 in the substrate, prior to binding. FIG. 10B illustrates the substrate after the binding step.

Figure 11A:
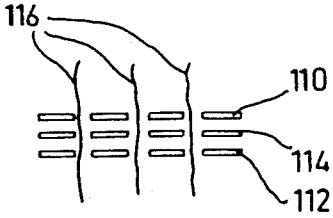
FIGS. 11A and 11B are illustrations of an alternative technique for retaining fibers in a substrate in accordance with an alternative embodiment of the present invention.
Figure 11B:
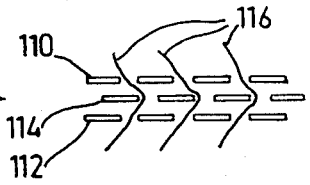

FIGS. 11A and 11B illustrate the use of an alternative technique for binding fibers in a substrate having multiple layers. In this embodiment, the substrate comprises first and second outer layers 110 and 112 and an inner layer 114 which is relatively movable with respect to layers 110 and 112. In FIG. 11A, all three layers have their perforations aligned, thereby permitting fibers 116 to become engaged therewith. Securing of fibers 116 within the substrate is achieved by sliding layer 114 with respect to layers 110 and 112 as seen in FIG. 11B. The layers are then all bonded together. The fibers tend to lie in a desired inclined orientation.

Further in accordance with an embodiment of the present invention, there is provided a technique for producing a fabric comprising the steps of producing a fabric substrate, and causing individual fibers to develop on the fabric substrate. The fiber development may be, for example, by means of organic growing, such as the growth of a plant type organism, on the substrate, or through the substrate. Alternatively the fiber development may comprise crystal growth and development. The production of fiber like crystal structures is described, for example, in the following publications:

J. H. Perry, Chemical Engineer's Handbook, 3rd Edition, 1950.

A. D. Fedoseev and T. A. Makarova, Growth of Crystals, Vol. 6A (Russian) Ed. N. W. Sheftal. Consultants Bureau, New York, 1968.

Additionally in accordance with an embodiment of the present invention, a fabric may be produced in accordance with the present invention by starting with a finished fabric produced, for example, by the apparatus of FIG. 5. It is noted that this starting fabric is formed of outwardly extending individual fibers. If this fabric is used as a mold and a fiber forming substance is applied thereover and the mold is then removed, a fabric having hollow fibers will be produced.

Alternatively, the original starting fabric may be retained and is thus coated with the forming substance. As a further alternative, the starting fabric fibers may be replaced by another material.

It will be appreciated that conventional garments such as skirts, pants and coats may be formed partly in accordance with the present invention by bonding a conventionally manufactured item, such as a pants waistband, onto a shaped element constructed in accordance with the present invention.

It will be appreciated by persons skilled in the art that the present invention is not limited to what has been particularly shown and described hereinabove. Rather the scope of the present invention is limited only by the claims which follow:

I claim:

1. A method for producing a fabric item comprising the steps of:

producing a perforated stretchable substrate in the shape of the desired fabric item and having a multiplicity of perforations extending therethrough;

providing a pressurized flow of a liquid to said substrate producing a pressure gradient for inflating said substrate, thereby stretching it and expending the perforations thereof thereby to facilitate the entry of fibers thereinto;

supplying fibers to said pressurized flow of said liquid thereby causing said fibers to engage the perforations in said substrate by driving said fibers itno said enlarged perforations through means of said pressurized liquid in which said fibers are suspended;

terminating said pressurized flow of said liquid; and retaining said fibers in the perforations to define said fabric item.

2. A method according to claim 1 and wherein said fabric item comprises a shaped three dimensional garment.

3. A method for producing a fabric item according to claim 1 and wherein said producing step comprises the step of inserting a mold into a bath of fluidized plastic material.

4. A method according to claim 1 and wherein said producing step comprises the steps of producing a multilayered substrate.

5. A method according to claim 1 and wherein said producing step comprises extrusion of a web sleeve.

6. A method according to claim 1 and wherein said producing step comprises the step of perforating said substrate.

7. A method according to claim 1 or claim 3 and wherein said producing step comprises applying a substrate material to a mold having a plurality of protrusions defining perforations in said substrate.

8. A method according to claim 1 and wherein said producing step comprises applying a perforating roller over said substrate.

9. A method according to claim 1 and wherein said producing step comprises the steps of forming said substrate from a material including portions of a soluble substance interspersed therein and dissolving said soluble substance to define said perforations.

10. A method according to claim 1 and wherein said causing step comprises the step of producing a pressure gradient in the vicinity of said perforated substrate and providing individual fibers at the higher side of said pressure gradient such that the individual fibers engage the perforations in said substrate.

11. A method according to claim 1 and wherein said retaining step comprises the step of applying a binding agent to a surface of said substrate for binding said fibers in said substrate.

12. A method according to claim 1 and wherein said causing step comprises the step of causing said fibers to become looped through a pair of perforations for secure mounting thereof.

13. A method according to claim 1 and wherein said causing step occurs substantially simultaneously over an entire predetermined area defining a garment.

* * * * *